US007159252B2

(12) United States Patent
Underbrink et al.

(10) Patent No.: US 7,159,252 B2
(45) Date of Patent: Jan. 9, 2007

(54) FOLDING SINK

(75) Inventors: John Underbrink, Richardson, TX (US); Peter C. Hill, Plano, TX (US)

(73) Assignee: Today's Gear, Inc., Edina, MN (US)

( * ) Notice: Subject to any disclaimer, the term of this patent is extended or adjusted under 35 U.S.C. 154(b) by 457 days.

(21) Appl. No.: 10/652,112

(22) Filed: Aug. 29, 2003

(65) Prior Publication Data

US 2004/0040084 A1 Mar. 4, 2004

Related U.S. Application Data

(63) Continuation of application No. 10/008,648, filed on Nov. 9, 2001, now Pat. No. 6,611,972.

(51) Int. Cl.
*A47K 1/04* (2006.01)
*A47K 1/00* (2006.01)

(52) U.S. Cl. ..... 4/619; 4/678; 4/625; 4/626

(58) Field of Classification Search ..... 4/619, 4/650, 620, 624, 675, 678, 625, 626, 516, 4/520.1, 520.2, 520.3; 137/801, 615, 616.7
See application file for complete search history.

(56) References Cited

U.S. PATENT DOCUMENTS 449,430 A 3/1891 Polakoff et al.
602,494 A 4/1898 Briggs
2,594,938 A 4/1952 Leavitt
2,739,778 A 3/1956 Krone et al.
3,410,487 A * 11/1968 Hyde ..... 137/625.17
3,593,961 A * 7/1971 Stewart ..... 251/349
3,993,376 A 11/1976 Meldahl
4,305,166 A 12/1981 Rose
4,727,906 A * 3/1988 Holzer ..... 137/616.7
4,761,839 A 8/1988 Ganaway
D342,212 S 12/1993 Lim
5,301,376 A 4/1994 Herbert
5,349,708 A 9/1994 Lee
5,381,567 A 1/1995 Tanner et al.
5,530,972 A 7/1996 Tanner
5,579,073 A 11/1996 Ben-Yaacov
5,740,569 A 4/1998 Gurries et al.
6,131,929 A 10/2000 Haley
6,161,228 A 12/2000 Wietecha
6,427,259 B1 8/2002 Cawthon

* cited by examiner

*Primary Examiner*—Khoa D. Huynh
(74) *Attorney, Agent, or Firm*—Gerald E. Helget; Nelson R. Capes

(57) ABSTRACT

A sink may include a basin and a faucet assembly foldably mounted relative to the basin. The faucet assembly is rotatable between an upright position wherein the faucet assembly protrudes out from the basin and a folded position wherein the faucet assembly is received within the basin.

12 Claims, 14 Drawing Sheets

FOLDING SINK

This application is a continuation of and claims priority to U.S. patent application Ser. No. 10/008,648, which was filed on Nov. 9, 2001 and issued as U.S. Pat. No. 6,611,972 on Sep. 2, 2003.

FIELD

The invention relates to sinks and portable storage cabinets and, in particular, to a sink with a foldable faucet assembly and a multi-purpose portable support cabinet.

BACKGROUND

Over the years, outdoor and garden or backyard activities have become increasing popular. However, workplace and family demands in today's busy lifestyles often leave little time to organize and assemble all the necessary gear, such as gardening implements or food preparation and serving utensils prior to commencing such activities and then for cleaning and reorganizing such equipment after the activity is over. Gardening or barbecue accessories, for example, are often stored haphazardly out of sight in garages or basements and in boxes for extended periods of time, such as during the cold weather months, and then have to be retrieved at a moment's notice for the first warm and sunny afternoon.

In addition to convenient storage, easy access to a sink for cleaning outdoor equipment and utensils of the various outdoor activities is particularly desirable. U.S. Pat. No. 5,349,708 to Lee discloses a foldable kitchen sink that includes two support members that are hinged to each other such that their upper surfaces may be deployed in a facing folded position or in a coplanar unfolded position. One support member has a dishwasher bucket mounted thereto; the other support member has a grille mounted thereto. The sink can be folded and transported, but does not include a faucet assembly for connection to a water supply.

U.S. Pat. No. 6,131,929 to Haley discloses a portable modular cart and game table that includes a faucet assembly and a sink basin mounted on the upper surface of the cart. A cover is connected to the cart and is movable between a first position that overlies the sink basin and a second position providing access to the sink basin. The faucet assembly is rotatable 360 degrees and collapsible, so that the faucet assembly assumes the upright position when the cover is in the second position and collapses axially when the cover is in the first position. The location of the faucet assembly occupies desirable counter top area which could be used to support utensils and other items.

There remains, therefore, a need for a sink with the faucet assembly that can be installed on outdoor equipment and that includes features that overcome the limitations, shortcomings and disadvantages of other sinks without compromising their advantages.

SUMMARY

The invention meets the identified needs, as well as other needs, as will be more fully understood following a review of this specification and drawings.

In one general aspect, a sink may include a basin and a faucet assembly foldably mounted relative to the basin. The faucet assembly is rotatable between an upright position wherein the faucet assembly protrudes out from the basin and a folded position wherein the faucet assembly is received within the basin.

Aspects of the invention also may include embodiments of a serving cart, a gardening cart and a barbecue station, each including a sink with a foldable faucet assembly and a slidable table portion or pivotable lid for covering the sink when the faucet assembly is in the folded position. The barbecue station may include a utility receptacle with a corresponding lid and an enclosed storing space with divided compartments, drawers and trays, which are accessible by opening one or more doors.

BRIEF DESCRIPTION OF THE DRAWINGS

FIG. 3(*b*) is an exploded view of an embodiment of a flow control valve of FIG. 3(*a*).

FIG. 3(*c*) is a partial sectional view through the actuator stem shown in FIG. 3(*a*).

FIG. 3(*d*) is a front view of an embodiment of a first mounting cover incorporated in the sink assembly of FIG. 1.

FIG. 3(*e*) is a front view of an embodiment of a second mounting cover incorporated in the sink assembly of FIG. 1.

FIG. 7(*a*) is an exploded view of an embodiment of the sink assembly of FIG. 6.

FIG. 8(*b*) is a sectional view of the manifold of FIG. 8(*a*) taken along axis VIIIb—VIIIb of FIG. 8(*a*).

DETAILED DESCRIPTION

Figure 1:
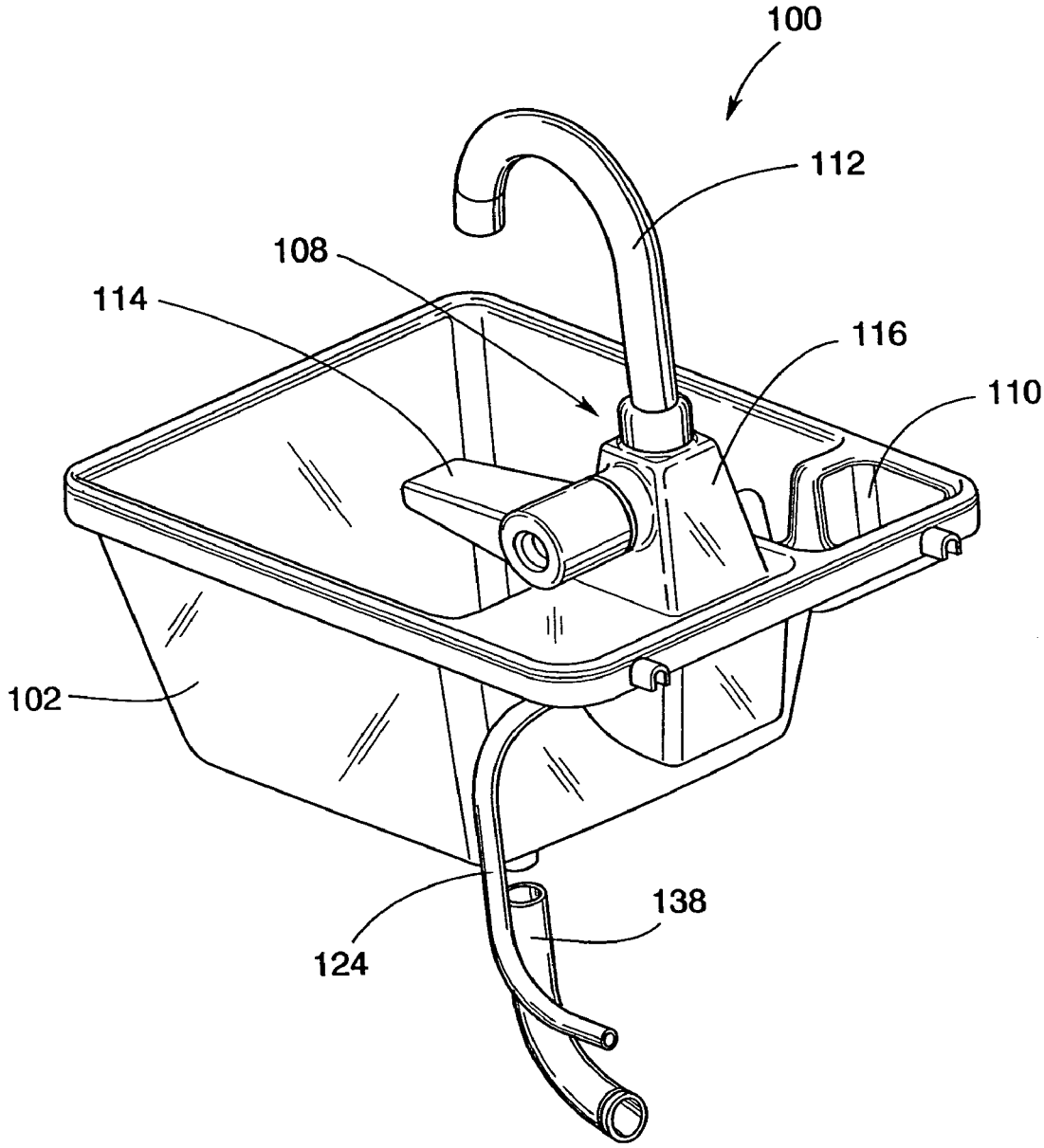
FIG. 1 is an isometric view of an embodiment of a sink with a faucet assembly in the upright position according to the invention.

Referring now to the drawings for the purpose of illustrating the invention and not for the purpose of limiting the same, it is to be understood that standard components or features that are within the purview of an artisan of ordinary skill and do not contribute to the understanding of the various embodiments of the invention are omitted from the drawings to enhance clarity, even when such features may otherwise be necessary for the function of a sink embodying the invention. In addition, it will be appreciated that the characterizations of various components described herein as moving, for example, upwardly or downwardly, or being vertical or horizontal, are relative characterizations only based upon the particular position or orientation of a given component for a particular application.

Figure 2:
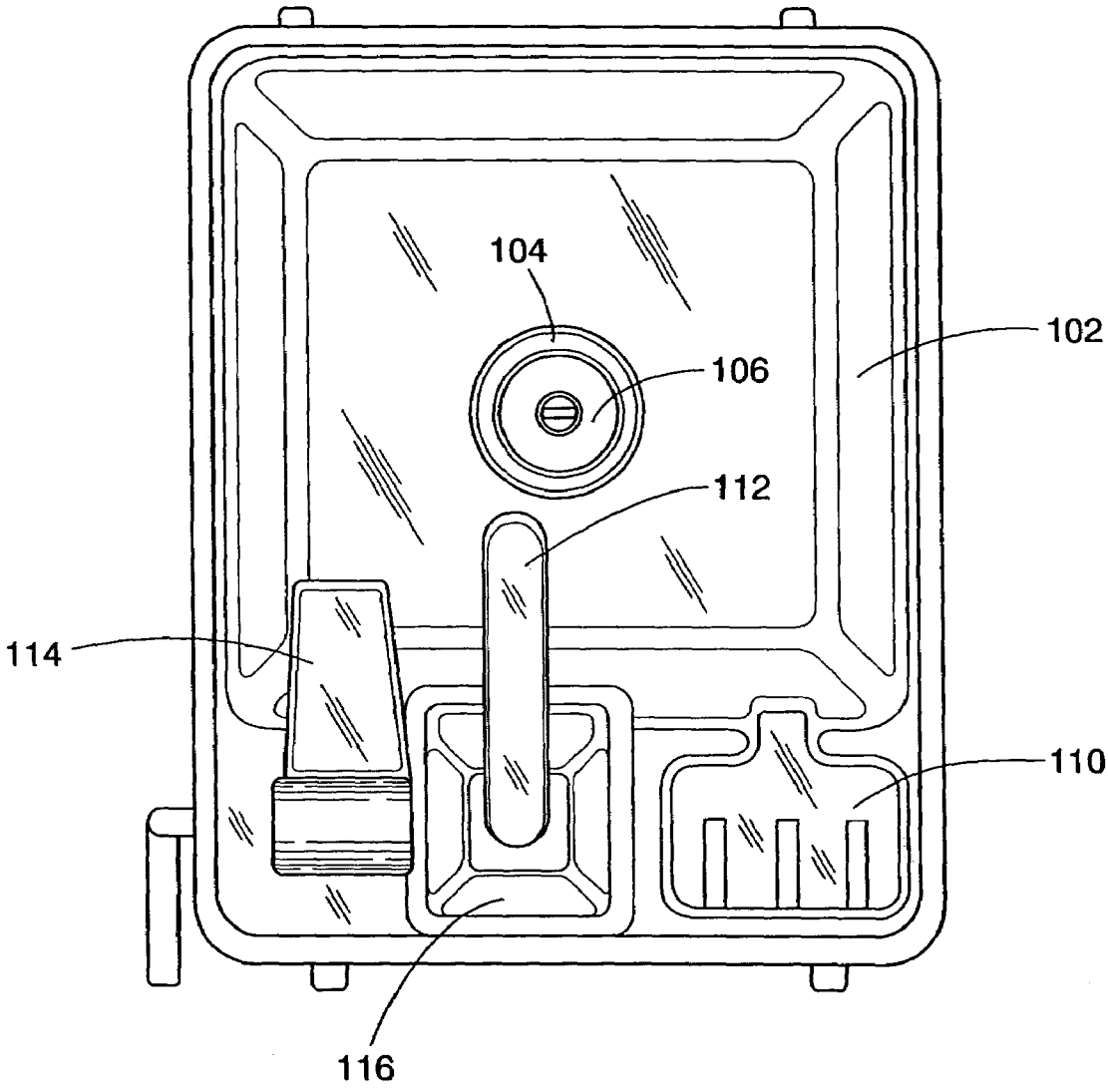
FIG. 2 is a top view of the sink of FIG. 1.
Figure 3A:
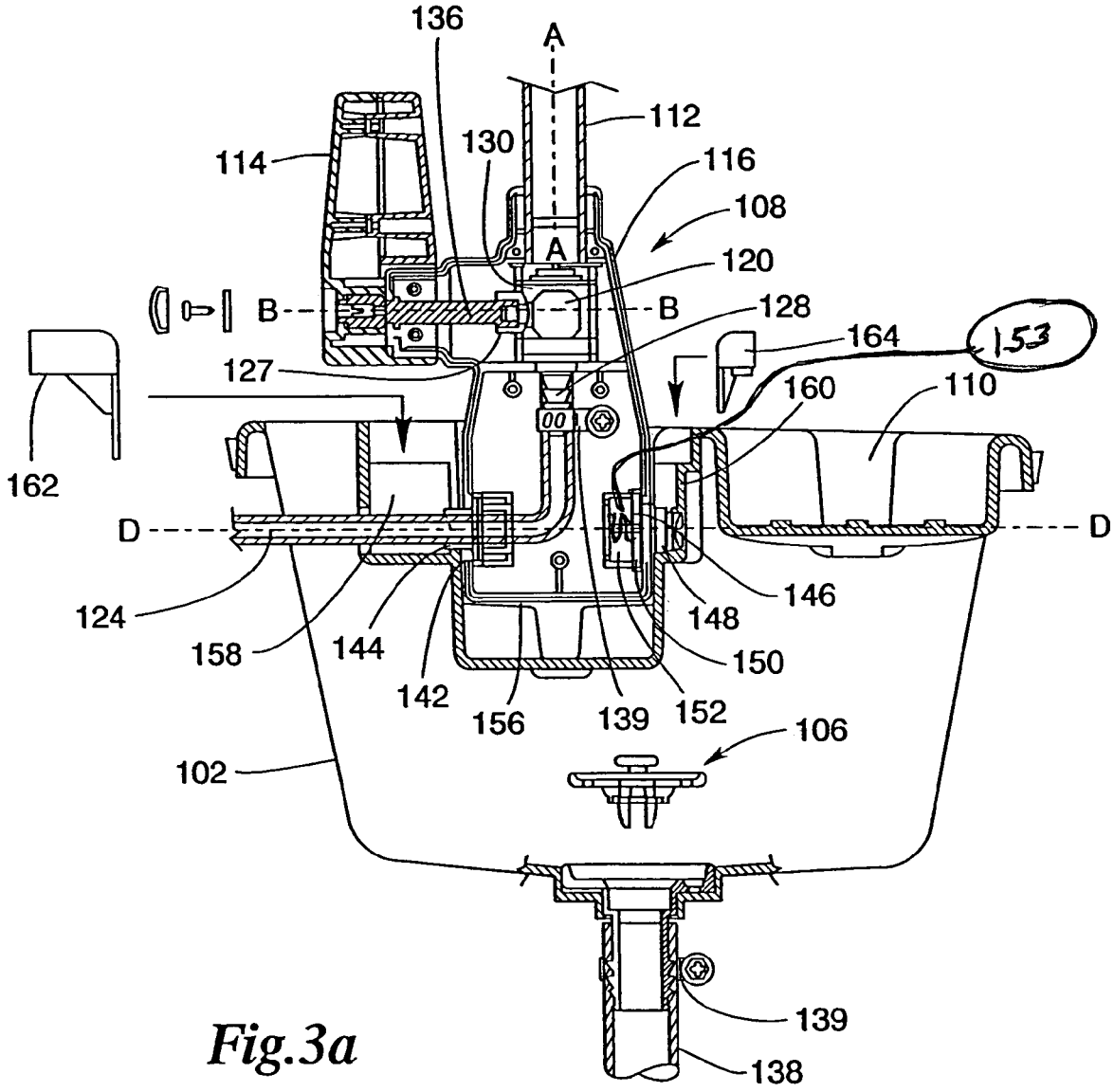
FIG. 3(*a*) is a partially exploded sectional view of the sink and faucet assembly of FIG. 1 with some components shown in cross-section.
Figure 3C:
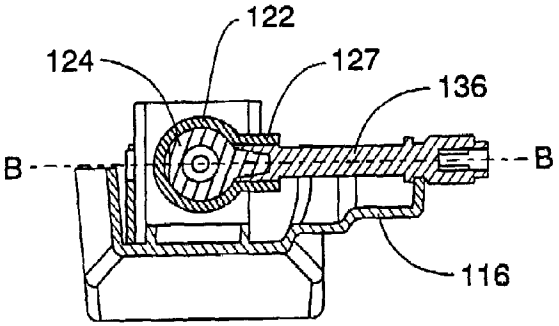
Figure 3E:
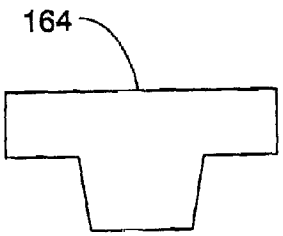
Figure 3D:
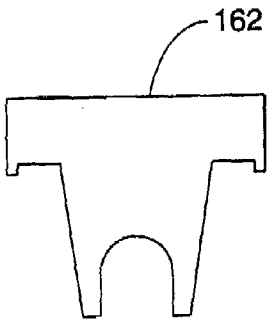
Figure 3B:
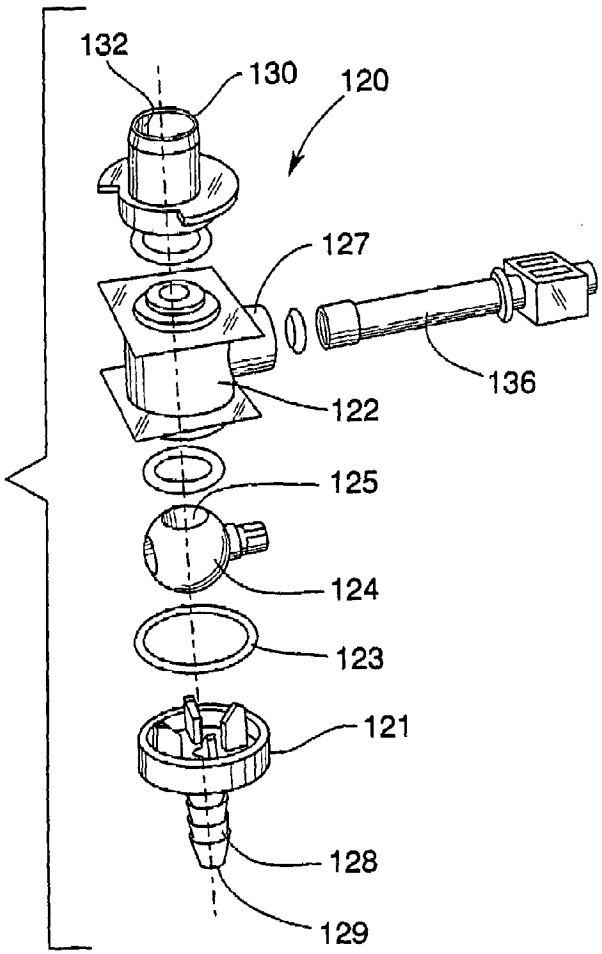
Figure 4:
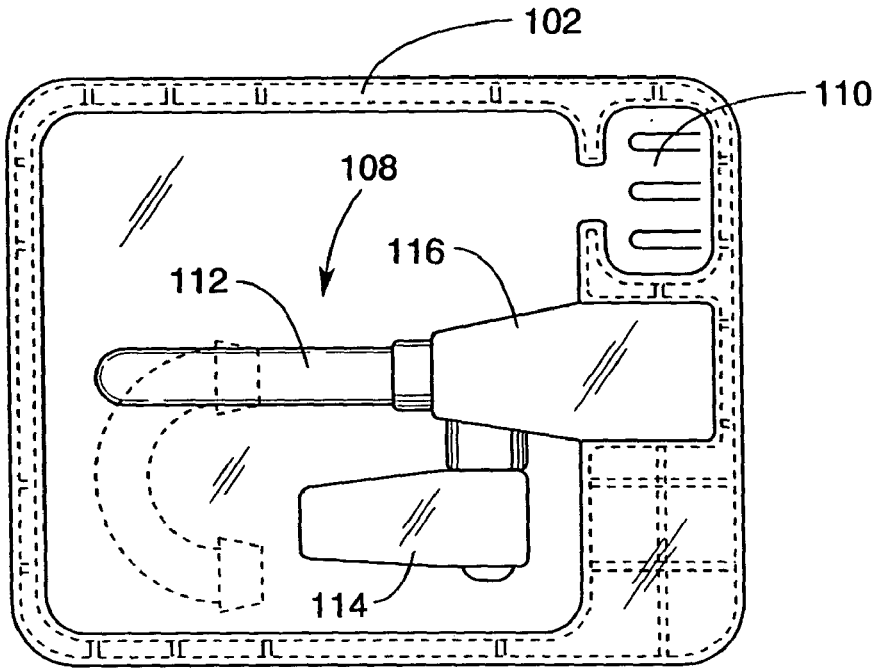
FIG. 4 is a top view of the sink of FIG. 1 with the faucet assembly in a folded position.

FIGS. 1 and 2 depict an embodiment of a sink 100 according to the invention. The sink 100 includes a basin 102 having a drain 104. A two-sided drain stopper 106, shown in more detail in FIG. 3, may be used to strain liquid exiting the basin through the drain 104 or to plug the drain 104. The basin 102 may be produced and assembled from food-grade materials when the sink 100 is to be used for food preparation and serving. It will be appreciated, however, that the basin 102 could be fabricated from a myriad of other suitable materials, such as stainless steel, aluminum, etc., and be provided in a variety of different shapes. The sink 100 may also include a soap tray 110 and other support surfaces, which may be molded in the basin 102. A faucet assembly 108 is mounted on the basin 102 and includes a discharge neck 112, a handle 114 or other suitable lever or knob for controlling liquid flow through the faucet assembly 108.

As indicated above, this embodiment of the sink 100 also employs a unique and novel faucet assembly 108. In this embodiment, the faucet assembly 108 includes a faucet housing 116 that pivotally supports the discharge neck 112 on the basin 102. More particularly and with reference to FIGS. 3(*a*) and (*b*), the faucet housing 116 is generally hollow and may be fabricated in two pieces that are retained together by, for example, screws, adhesive, etc. The skilled artisan will readily appreciate that by employing screws to affix the portions of housing 116 together, the user can quickly disassemble the housing 116 to replace any of the components therein.

The faucet housing 116 supports a flow control valve 120 that includes a valve housing 122 that is supported in the faucet housing 116 by a mounting collar 121 that includes an inlet conduit barb 128. See FIG. 3(*b*). An O-ring 123 is fitted between the valve housing 122 and the collar 121. The inlet conduit barb 128 defines an inlet passage 129. Likewise, an outlet mounting flanged connector 130 is supported through an O-ring on the valve housing 122 opposite the inlet conduit barb 128 and defines an outlet passage 132 therethrough. The discharge neck 112 may be rotatably received on the outlet mounting flanged connector 130 for rotational travel thereon about an axis "A—A". See FIG. 3(*a*). Rotatably supported in the housing 122 between the inlet passage 129 and outlet passage 132 is a flow control member 124'. The flow control member 124' has a flow passage 125 therethrough that, when aligned with the inlet passage 129 and outlet passage 132, permits a fluid entering through the inlet passage 129 to flow through the valve 120.

In the embodiment depicted in FIG. 3(*a*), an actuator stem 136 is attached to a side connector 127 of the valve housing 122. The actuator stem 136 is rotatably supported in a portion of the faucet housing 116, as shown in FIG. 3(*c*), and has a handle 114 attached thereto. The handle 114 permits the user to selectively rotate the flow control member 124' about an actuator axis "B—B". Thus, when the flow control member 124' is rotated such that the flow control passage 125 is aligned with the inlet passage 129 and the outlet passage 132, fluid can flow through the valve 120. If the flow control passage 125 is oriented at a ninety-degree angle to the inlet passage 129 and the outlet passage 132, no fluid is permitted to pass through the valve 120.

A supply conduit 124, which is coupled to a source of liquid, passes through a hole 142 in the faucet housing 116. In this embodiment, the supply conduit 124 may comprise a section of flexible hose which is coupled to the inlet conduit barb 128 by, for example, conventional means, such as a hose clamp 139. A flanged mounting bushing 144 that has a passage therethrough supports the supply conduit 124 where it enters the faucet housing 116. As can be seen in FIG. 3(*a*), the mounting bushing 144 also provides a means for pivotally coupling the faucet housing 116 to the basin 102. Protruding out through a hole 146 in an opposite side of the housing 116 is a mounting peg 148. The mounting peg 148 is provided with a flanged portion 150 that is larger than the hole 146 to prevent the mounting peg 148 from passing completely through the hole 146. The flanged portion 150 may include grooves that mate with corresponding protrusions in the faucet housing 116 to retain the mounting peg 148 in position. Alternatively, a biaser cavity 152 may be provided in the housing 116 for supporting a biasing member in the form of a spring to bias the mounting peg 148 in an outward direction away from the faucet housing 116.

To install the faucet assembly 108 on the sink, the faucet housing 116 is inserted into a cavity 156 in the sink 102. The cavity 156 may include a first mounting enclosure 158 receiving the mounting bushing 144 and a second mounting enclosure 160 receiving the mounting peg 148. A first mounting cover 162 may be inserted over the top of the first enclosure 158. The first mounting cover 162 snaps in over the mounting bushing 144 and secures it in place. Similarly, a second mounting cover 164 may be inserted over the top of the second mounting enclosure 160, snapping in over the mounting peg 148. See FIGS. 3(*a*), 3(*d*) and 3(*e*). The first mounting cover 162 and the second mounting cover 164 may also be secured to the basin 102 with hidden fasteners, such as screws that are threaded from the outer surface of the basin through holes located on molded surfaces of the first and second mounting enclosures 158, 160.

Other ways of supporting the faucet housing on the basin of the sink are within the purview of one of ordinary skill in the art. For example, the mounting bushing 144 and the mounting peg 148 may be received within respective holes in the walls of the basin, in connection with the embodiment described above that includes a spring in the biasing cavity 152. The spring facilitates retention of the mounting peg 148 in its respective hole to retain the faucet housing 116 in the basin 102. It will be appreciated, however, that such arrangement would permit the faucet assembly 108 to be detached from the basin 102, if desired, for storage purposes, repair purposes, etc.

Figure 5:
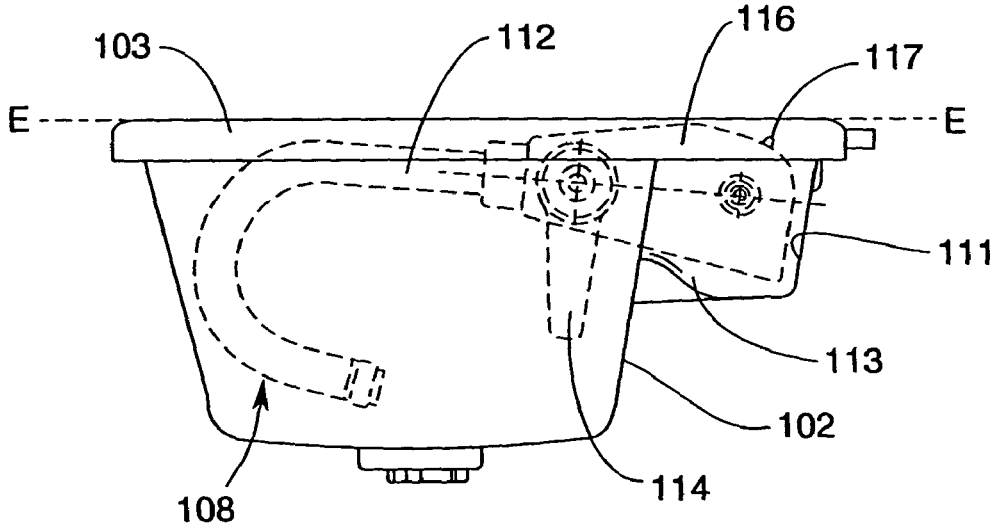
FIG. 5 is a side view of the sink of FIG. 1 with the faucet assembly in a folded position.

When the mounting bushing 144 is received in the first mounting enclosure 158 and the mounting peg 148 is received in second mounting enclosure 160, the person of ordinary skill in the art will appreciate that the faucet assembly 108 can pivot about an axis "D—D" defined by the mounting bushing 144 and mounting peg 148. See FIG. 3(*a*). In particular, the faucet assembly 108 may be pivoted through an angle of approximately ninety degrees from an upright position shown in FIG. 1, wherein at least a portion of the faucet assembly 108 protrudes from the basin to other positions including a folded storage position inside the basin 102, such that the entire faucet assembly 108 is below a plane "E—E" defined by the top 103 of the basin 102. See FIG. 5. The basin 102 may include a retainer 113 that releasably retains the faucet assembly 108 in the folded position. The retainer 113 may be fabricated as an integral part of the basin 102, by molding, for example. The rear surface of the faucet housing 116 may include two symmetric pivot detents 117, which may be attached or molded thereon, to facilitate pivoting the faucet assembly 108 against an interior rear surface 111 of the basin 102 and to stabilize the faucet assembly 108 in the upright position.

In one embodiment of the invention, the above-described sink 100 may be employed in a sink assembly, generally indicated as 200. The sink assembly 200 may include a sink housing 202 that has a top portion 204 with a top surface 203 and a mounting bracket 206. See FIG. 6. The top portion 204 includes a top recess 208 in which the sink 100 may be received. The sink assembly 200 may be fabricated from blow molded plastic or other suitable processes and materials that are relatively lightweight and that can withstand the elements, if stored outside. However, the sink assembly 200 could also be fabricated from a myriad of other materials such as steel, stainless steel, aluminum, etc.

The sink assembly 200 may be mounted on a wall or other convenient structure and may include a rack 210 for coiling a garden hose 212 or other conduit therearound. The rack 210 may have a convenient storage compartment 214 formed therein for holding sprinklers, nozzles, sprayers etc. The storage compartment 214 may have a cover 216 with a handle 217 for opening and closing the cover 216 or may be fitted with a drawer (not shown).

Figure 6:
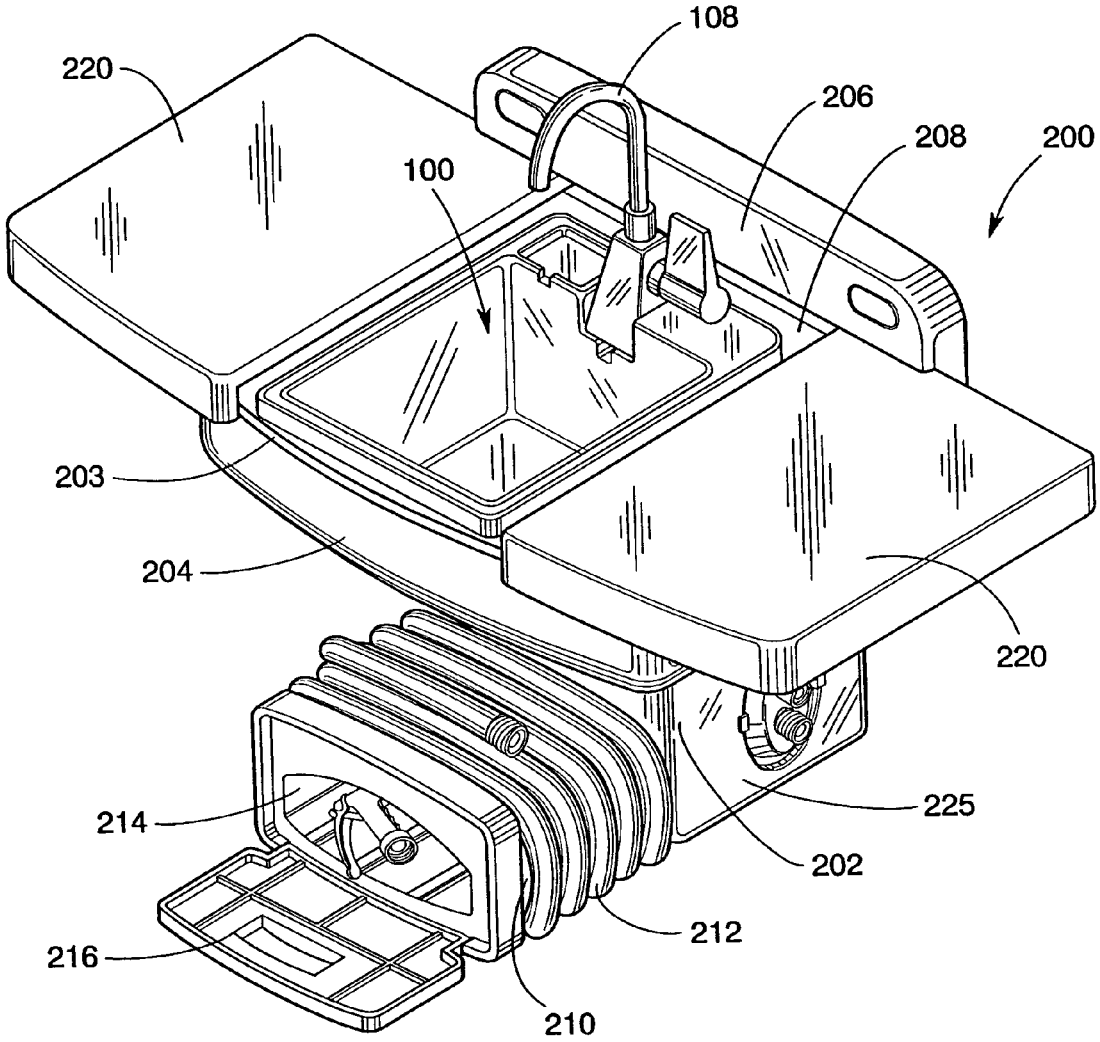
FIG. 6 is an isometric view of an embodiment of a sink assembly incorporating the sink of FIG. 1.
Figure 7:
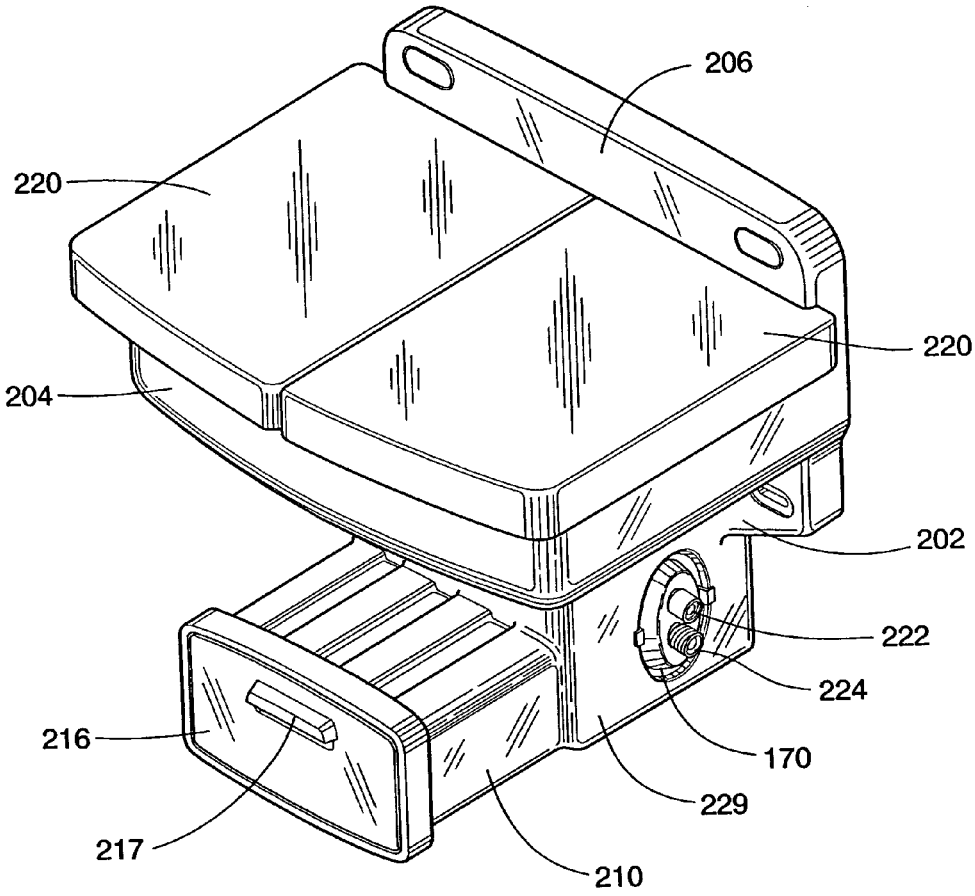
FIG. 7 is an isometric view of the sink assembly of FIG. 6 with the sink covered.
Figure 7A:
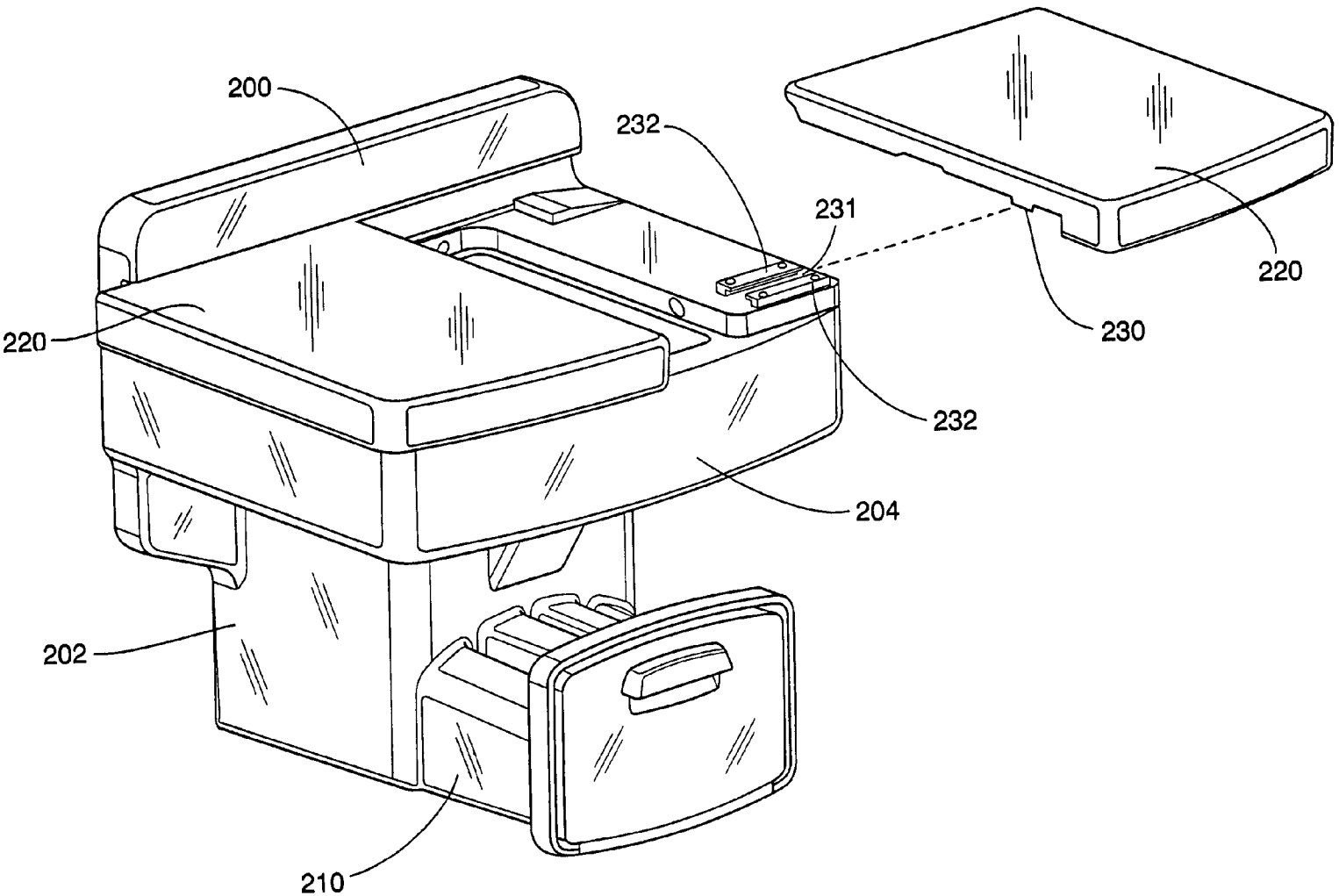

The sink assembly 200 may also include a pair of table portions 220 that are slidably affixed to the sink housing 202 for moving between open positions shown in FIG. 6 and closed positions shown in FIG. 7. Each of the table portions may have, for example, a protrusion 230 that slides into a mating recess 231 formed by guides 232 on the top portion 204 of the sink housing 202. See FIG. 7(*a*). The top portion 204 may be provided with stops to prevent the table portions 220 from sliding completely off the sink assembly 200. Those of ordinary skill in the art will appreciate that the table portions 220 may slide either together or independently of each other on the top portion 204 of the housing 202 to fully expose, partially cover or completely cover and protect the sink 100 when the faucet assembly 108 is in the folded position, and provide work and preparation surface area.

Figure 8B:
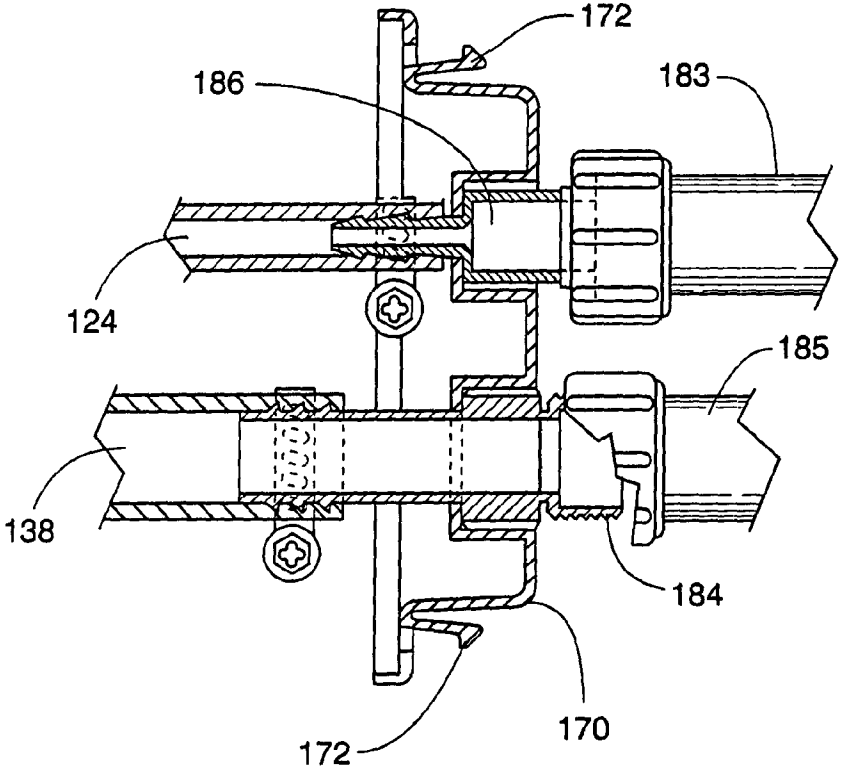
FIG. 8(*a*) is top view of an embodiment of a connecting manifold shown in FIG. 7.
Figure 8A:
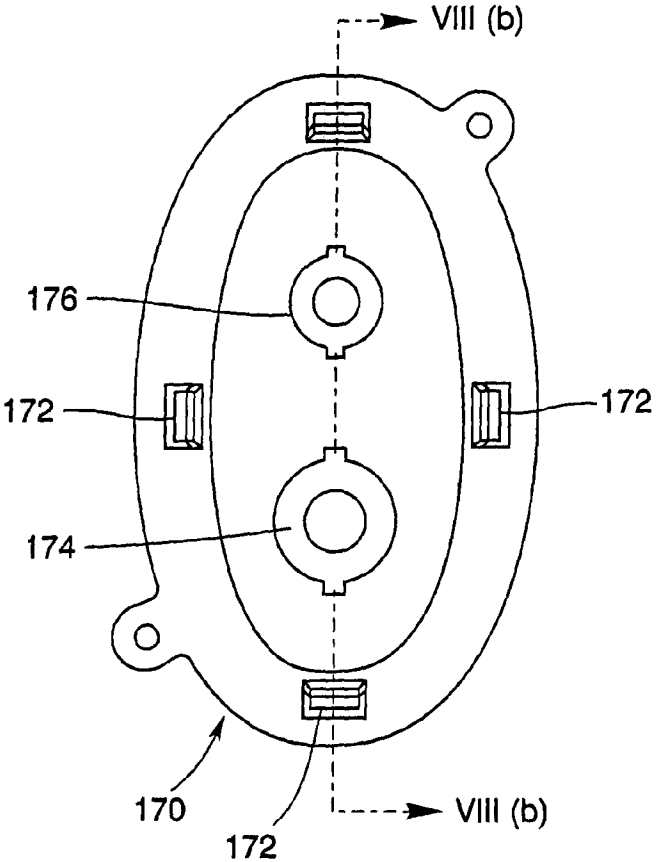

The sink housing 202 includes an inlet opening 222 for connection with the water supply conduit 124, and an outlet opening 224 for connection with a draining conduit 138. See FIG. 7, and FIG. 3(*a*) for the sink 100. The supply and draining lines may be conveniently connected through a connecting manifold 170, shown in FIGS. 8(*a*) and (*b*), that can be mounted on a side 225 of the sink assembly 200, either by conventional fasteners, such as screws or by snap-fitting on the side 225 of the sink assembly 200 by means of resilient snap lugs 172, which are, for example, integrally molded on the connecting manifold 170, when the connecting manifold is made of plastic material. The connecting manifold 170 includes a manifold outlet 174 and a manifold inlet 176. A manifold outlet or drain connector 184 may be inserted through the manifold outlet 174 and connect the drain conduit 138 to an extension drain conduit 185, and a manifold inlet connector 186 may be inserted through the manifold inlet 176 and connect the fluid supply conduit 124 to an extension supply conduit 183.

Figure 9:
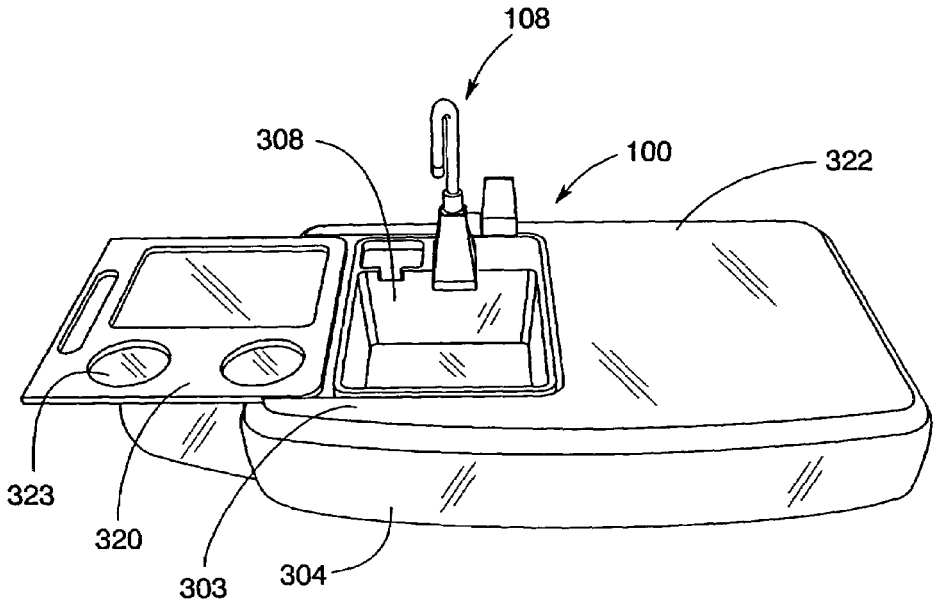
FIG. 9 is an isometric view of another embodiment of the top portion of the sink assembly of FIG. 7.

An alternative embodiment of a top portion 304 for the sink assembly 200 of FIG. 7 is shown in FIG. 9. The top portion 304 has a top surface 303 and includes a top receptacle 308 in which the sink 100 may be received, and a table portion 320 that is slidably attached to the top portion 304 in the manner described above and can be positioned to cover the sink 100 when the faucet assembly 108 is in the folded position. The table portion 320 may be removable and may also be used as a serving tray. The table portion 320 may also have molded depressions or surface receptacles 323 for safely supporting cutlery or dinnerware, cans, bottles, or other items. The top portion 304 may also include a working surface 322 on the other side of the sink 100.

Figure 10:
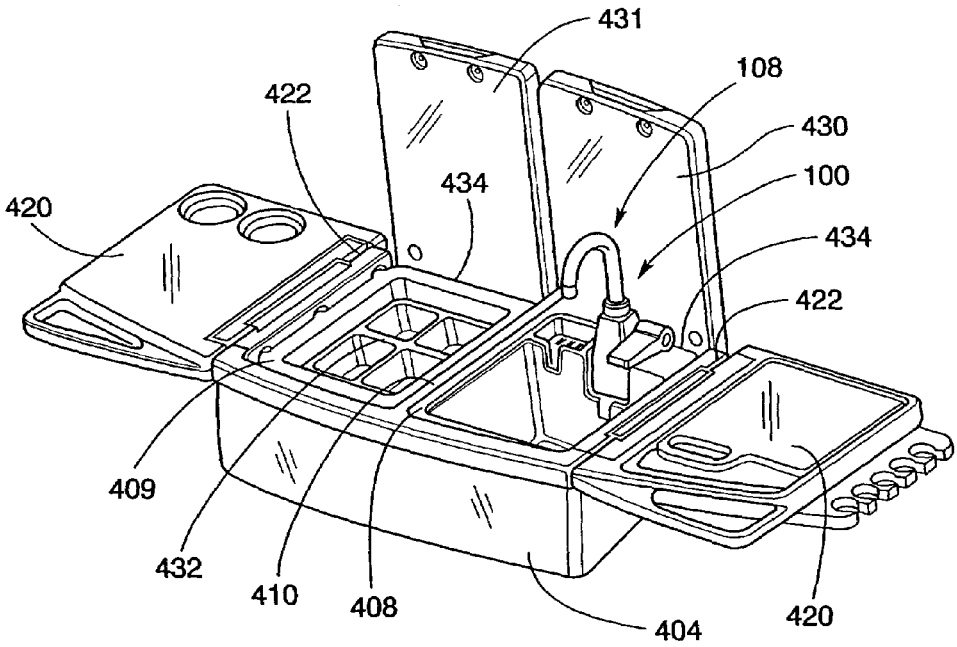
FIG. 10 is an isometric view of yet another embodiment of the top portion of the sink assembly of FIG. 7.

Yet another embodiment of a top portion 404 for the sink assembly 200 of FIG. 7 is shown in FIG. 10. In this embodiment, the top portion 404 has a top surface 403 and includes a first top receptacle 408 in which the sink 100 may be received, and a second top receptacle 409 that may be used for storage of food items, plants, etc., and may receive a basket 432 with divided compartments. In this embodiment, the first receptacle 408 is separated from the second receptacle 409 by a center wall portion 410. The top portion 404 may include table portions 420 that pivot about sides 422 to fold down, and a first lid 430 and second lid 431 pivotable about the back side 434 of the top portion 404 to either expose or cover the first top receptacle 408 or the second top receptacle 409, respectively.

Figure 11:
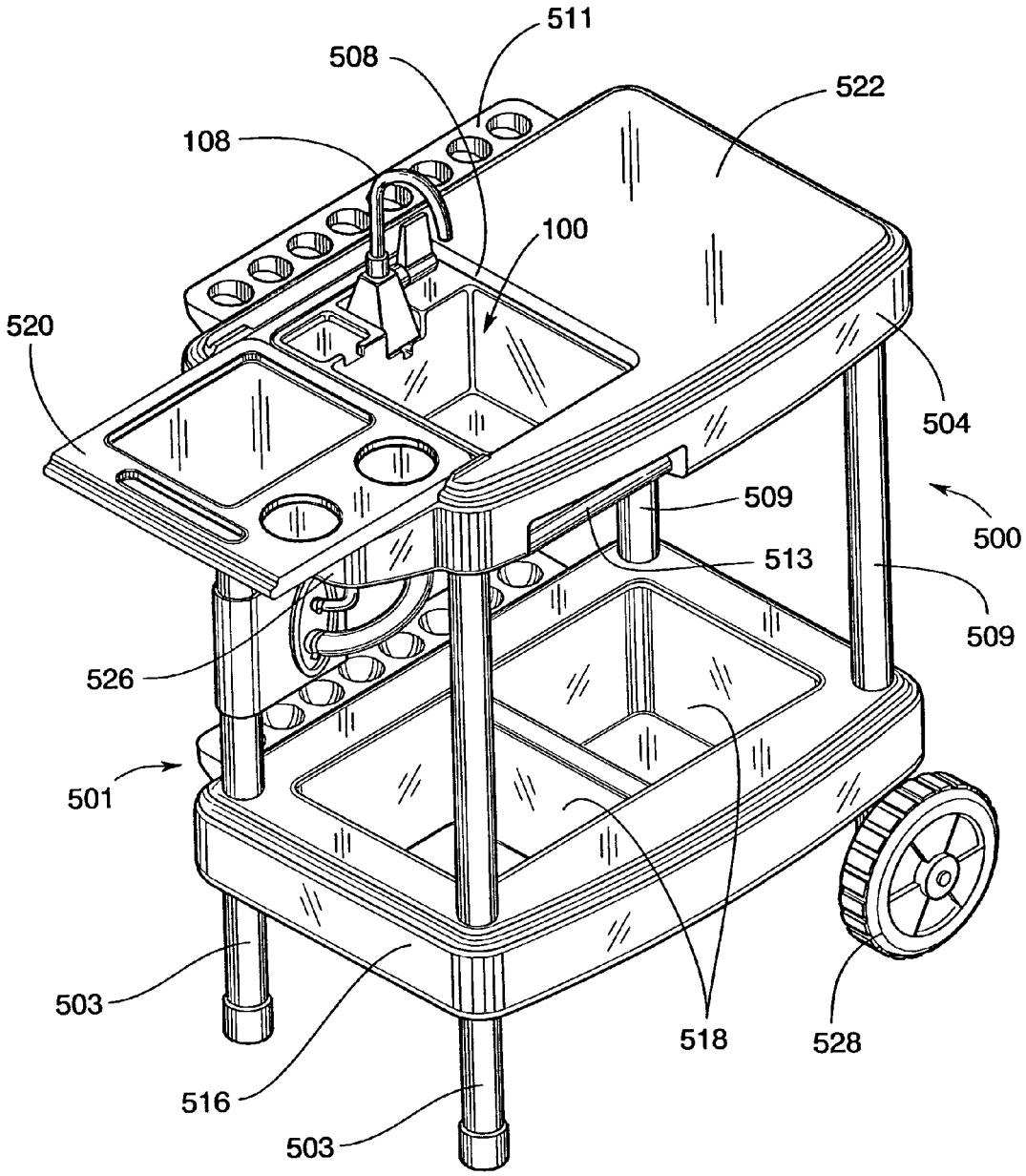
FIG. 11 is an isometric view of an embodiment of a cart incorporating the sink of FIG. 1.
Figure 12:
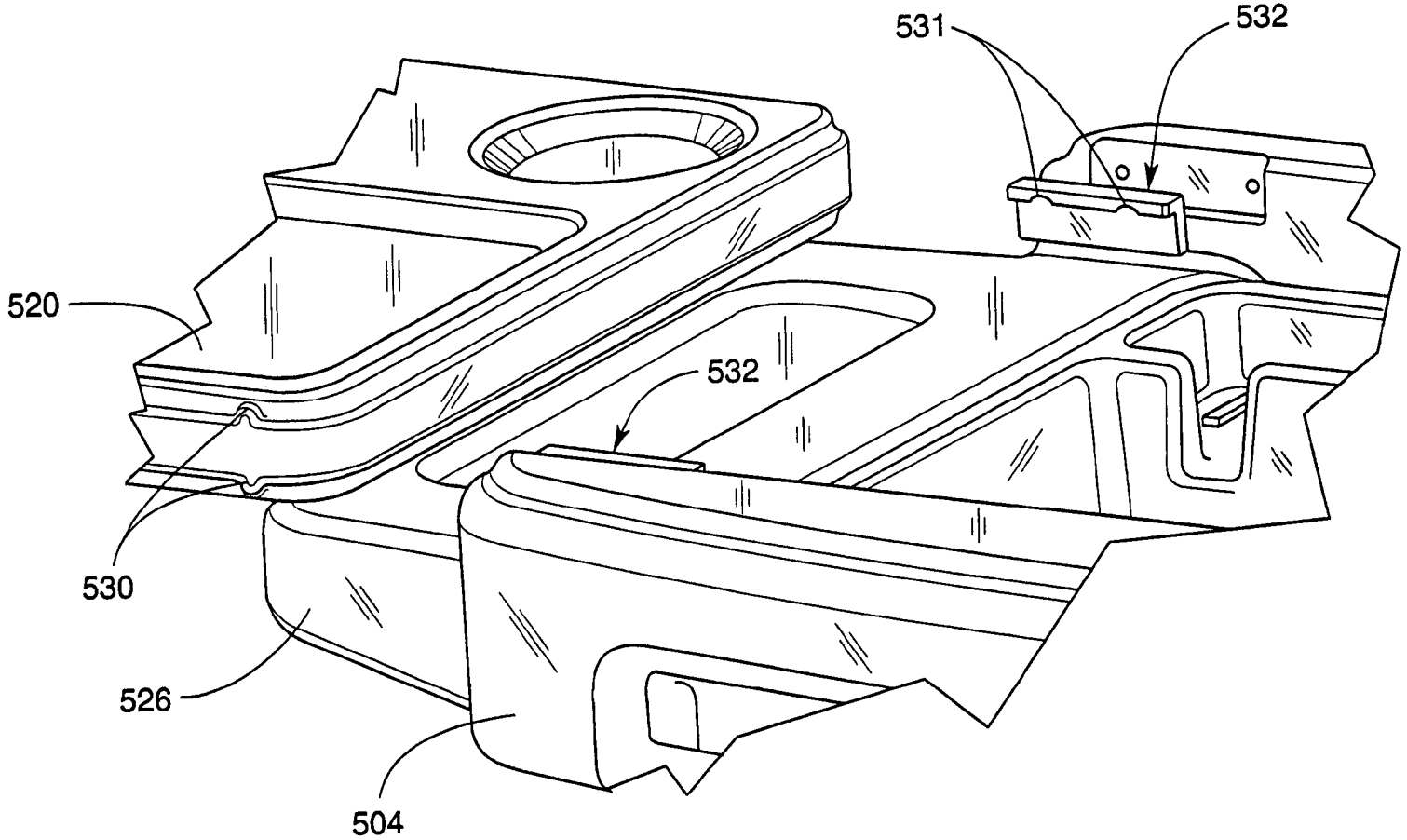
FIG. 12 is a partial exploded view of an embodiment of the cart of FIG. 11.
Figure 13:
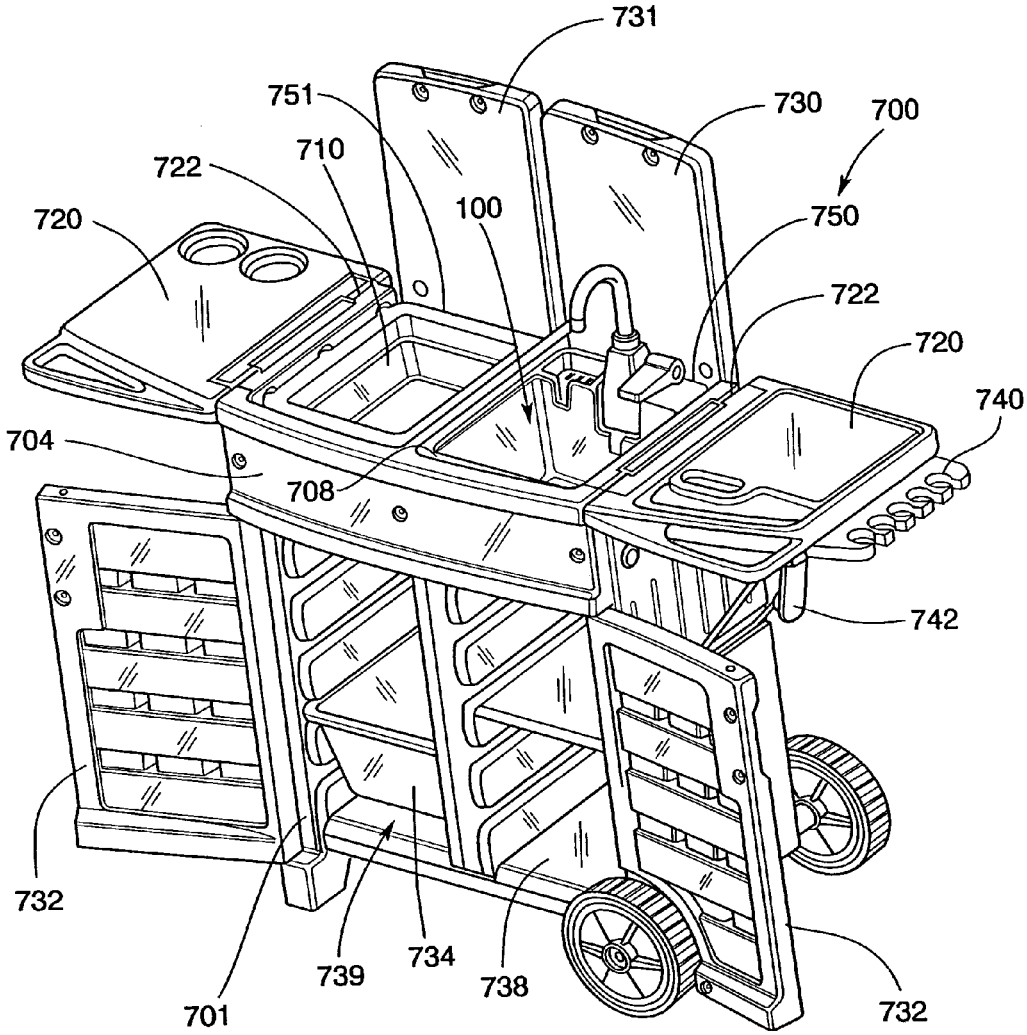
FIG. 13 is a front isometric view of yet another embodiment of a cart incorporating the sink of FIG. 1.

The sink 100 of FIG. 1 may also be mounted on a serving or garden cart 500 or a barbecue station 700, or on other suitable structures and cabinets, portable and non-portable, as shown in FIGS. 11–13. The serving cart 500 may include a frame 501 with a plurality of legs, such as, for example, a pair of support legs 503 and a pair of wheeled legs 505, on which a top panel 504 is supported. The serving cart 500 may also have two support legs 503 and only one wheeled leg 505 or four support legs or four wheeled legs, etc. The top panel 504 includes a receptacle 508 for receiving the sink 100 and may also have a work surface 522. The top panel 504 may also include a table portion 520 that can slide over and cover the sink 100, when the faucet assembly 108 is in the folded position. The table portion 520 may be removable and may also be used as a serving tray. A partial view of one embodiment illustrating the engagement of table portion 520 with the top panel 504 is shown in FIG. 12. The table portion 520 includes symmetric protrusions 530 that engage corresponding recesses 531 formed in slide guides 532.

The serving cart 500 may also include a rack 511 mounted on the back of the top panel 504 for supporting, for example, cups, cans or bottles, and a towel rack 513 integrally formed or mounted on the front side of the top panel 504. The serving cart 500 may also include a bottom panel 516 having one or more storage receptacles 518 for holding separately wet and dry items, such as, for example, drinks or ice and packaged food, respectively. When the table portion 520 is removed or slid over the sink 100, the serving cart 500 can be easily wheeled by pushing the handle 526, which is also partially supporting the table portion 520 in its extended position. The large wheels 528 mounted on the pair of the wheeled legs 505 facilitate portability of the serving cart 500.

The serving cart 500 may also be used for gardening and planting uses. The rack 511 may be used for holding gardening tools.

Figure 14:
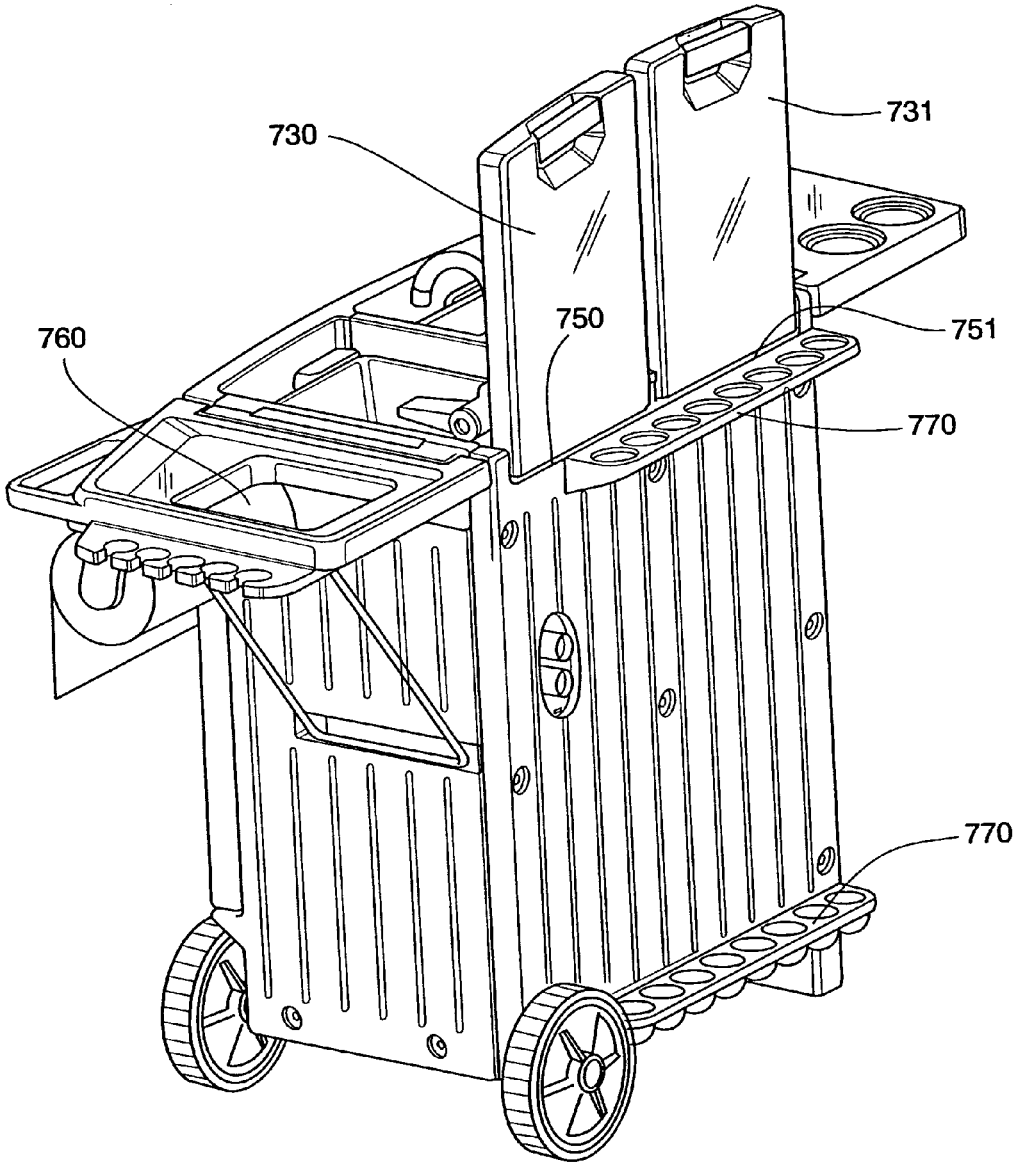
FIG. 14 is a rear isometric view of the cart of FIG. 13.

FIGS. 13 and 14 show a cart 700 that may be well-suited for use as a barbecue preparation station or a garden center. The cart 700 has a frame 701 and a top panel 704 that includes a sink receptacle 708 and a utility receptacle 710, for preparing or storing items. The cart 700 may also include a pair of extension plates 720 that can fold down by pivoting about respective sides 722 of the top panel 704. The cart 700 may further include an enclosed storage space 739 below the top panel 704. The storage space 739 is accessible through one or two doors 732 that are pivotably attached to the frame 701, and may include a storage drawer 734, a divided utensil or spice/condiment tray and a compartment 738 for larger items, such as charcoal/grill accessories, and other bulky containers, such as oil and vinegar bottles, marinade bottles, salt containers, etc. The cart may include hooks 740 for barbecue or other serving utensils, a paper towel holder 742, and a garbage bag holder 760. The cart 700 may also include a pair of pivotable lids 731 and 730 for covering the food receptacle 710 and the sink receptacle 708 respectively. The lids 731 and 730 may pivot over respective back edges 751 and 750 of the top panel 704. The extension plates 720 may also pivot to fold over the closed lids 730 and 731. Additional tool or utensil holders 770 may be provided in the back of the cart for other uses Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the invention as described in the appended claims. The preceding description, therefore, is not meant to limit the scope of the invention. Rather, the scope of the invention is to be determined only by the appended claims and their equivalents.

What is claimed is:

1. A sink comprising:

a basin;

a faucet assembly attached to the basin, the faucet assembly including:

a discharge neck, a handle for controlling liquid flow through the discharge neck, and a faucet housing supporting the discharge neck on the basin; and a mounting means for pivotally coupling the faucet housing to the basin such that the faucet assembly may be pivoted through an angle of approximately ninety degrees about a horizontal axis defined by the mounting means.

2. The sink of claim 1, wherein the basin includes a drain.

3. The sink of claim 1, wherein the basin includes a retainer for releasably retaining the faucet assembly in the folded position.

4. The sink of claim 3, wherein the retainer comprises one or more detents on the faucet housing.

5. The sink of claim 1, further comprising a flow control valve supported in the faucet housing.

6. The sink of claim 5, wherein the flow control valve comprises a connector for receiving the discharge neck.

7. The sink of claim 6, wherein the connector allows the discharge neck to rotate about a vertical axis.

8. The sink of claim 1, further comprising a conduit for supplying liquid to the faucet housing.

9. The sink of claim 1, wherein the faucet assembly may be pivoted between an upright position in which at least a portion of the discharge neck protrudes from the basin and a folded position in which the faucet assembly is below a plane defined by a top surface of the basin.

10. The sink of claim 1, wherein the mounting mans comprises a bushing received within an enclosure in the basin.

11. The sink of claim 1, wherein the mounting means comprises a peg received within an enclosure in the basin.

12. The sink of claim 11, wherein the peg is retained within the enclosure by a spring.

* * * * *